US007850495B2

(12) United States Patent
Niles et al.

(10) Patent No.: US 7,850,495 B2
(45) Date of Patent: Dec. 14, 2010

(54) ELECTRICAL CONTACTS

(75) Inventors: Paul D. Niles, Bainbridge, NY (US); Richard Lewis Barnes, Unadilla, NY (US); Jeremy Ruff, East Greenwich, RI (US)

(73) Assignee: Amphenol Corporation, Wallingford, CT (US)

( * ) Notice: Subject to any disclaimer, the term of this patent is extended or adjusted under 35 U.S.C. 154(b) by 0 days.

(21) Appl. No.: 12/370,751

(22) Filed: Feb. 13, 2009

(65) Prior Publication Data

US 2010/0210151 A1 Aug. 19, 2010

(51) Int. Cl.
*H01R 13/187* (2006.01)

(52) U.S. Cl. ..... 439/843; 439/879; 439/930

(58) Field of Classification Search ..... 439/930, 439/843, 851, 879
See application file for complete search history.

(56) References Cited

U.S. PATENT DOCUMENTS

| | | | | |
|---|---|---|---|---|
| 3,381,262 | A * | 4/1968 | Jeanrenaud | 439/843 |
| 3,470,527 | A * | 9/1969 | Bonhomme | 439/843 |
| 3,725,844 | A | 4/1973 | McKeown et al. | |
| 4,082,398 | A | 4/1978 | Bourdon et al. | |
| 4,120,556 | A | 10/1978 | Waldron et al. | |
| 4,221,446 | A | 9/1980 | Niles et al. | |
| 4,253,234 | A | 3/1981 | Niles et al. | |
| 4,278,317 | A | 7/1981 | Gallusser et al. | |
| 4,470,658 | A | 9/1984 | Hemmer et al. | |
| 5,951,314 | A * | 9/1999 | Durand-Cochet et al. | 439/252 |
| 6,010,369 | A * | 1/2000 | Itabashi et al. | 439/660 |
| 6,102,746 | A * | 8/2000 | Nania et al. | 439/675 |
| 7,160,156 | B2 * | 1/2007 | Holliday | 439/879 |
| 2009/0036003 | A1 * | 2/2009 | Morana et al. | 439/843 |

* cited by examiner

*Primary Examiner*—Michael C Zarroli
(74) *Attorney, Agent, or Firm*—Blank Rome LLP

(57) ABSTRACT

A device of and method for an improved electrical contact is disclosed. The electrical contact includes a plurality of axially-aligned electrically conductive wires, each wire being in electrical contact with at least one other wire at a peripheral surface thereof; an electrically conductive inner sleeve disposed around the plurality of wires and having at least one slot extending axially from a leading end that is adapted to allow the inner sleeve to expand radially; an outer shell disposed around the inner sleeve for protecting at least a leading end of the plurality of wires and the inner sleeve; and an attaching portion disposed at a terminal end of the plurality of wires, the inner sleeve, and the outer shell, the attaching portion being in electrical contact with at least the plurality of wires and the inner sleeve and being adapted to place at least the plurality of wires and the inner sleeve in electrical contact with a first electronic device.

20 Claims, 2 Drawing Sheets

ELECTRICAL CONTACTS

FIELD OF THE INVENTION

This invention relates to insertable and removable contacts for electrical connector assemblies. More particularly, the present invention relates to improvements to pin-and-socket and brush type contacts.

BACKGROUND OF THE INVENTION

Electrical connector assemblies generally include a plug and receptacle. A common type of plug and receptacle connector utilizes pin (plug) and socket (receptacle) terminals. Such pin-and-socket contacts are of the male and female type, wherein an electrical interconnection is made between the contacts by inserting the male pin into the female socket. Another type of plug and receptacle connector assembly utilizes a pair of brush type terminals. Sometimes referred to as bristle brush bunch contacts, or $B^3$ contacts, such brush type contacts are hermaphroditic, wherein each of the contacts includes a bundle of wires. An electrical connection is made between the contacts by intermeshing the bundled wires of one contact with the bundled wires of the other.

Because of their different configurations, pin-and-socket type contacts and brush type contacts each have different operating characteristics with different benefits and drawbacks. Among the different operating characteristics are the contacts' ability to fit in high-density connector assemblies, i.e., size; to carry the appropriate amount of current; and to stay coupled during shock and vibration conditions. For example, pin-and-socket type contacts are typically larger in size (12 gauge and larger) and carry larger electric current (50 amperes to 500 amperes) while brush type contacts are typically smaller in size (22 gauge and smaller) and carry smaller electric current (5 amperes and smaller). Accordingly, pin-and-socket type contacts are typically used as power terminals and brush-contacts are typically used as digital signal terminals. Pin-and-socket type contacts often come loose, however, under sever shock and vibration conditions where brush type contacts can maintain good electrical contact during such conditions. Accordingly, there remains a need for contact assemblies that can be used in high-density connector assemblies while providing for large current applications and that remain coupled even under severe shock and vibration conditions.

SUMMARY OF THE INVENTION

Accordingly, to solve at least the above problems and/or disadvantages and to provide at least the advantages described below, a non-limiting object of the present invention is to provide a device of and method for an electrical contact that includes a plurality of axially-aligned electrically conductive wires, each wire being in electrical contact with at least one other wire at a peripheral surface thereof; an electrically conductive inner sleeve disposed around the plurality of wires and having at least one slot extending axially from a leading end that is adapted to allow the inner sleeve to expand radial; an outer shell disposed around the inner sleeve for protecting at least a leading end of the plurality of wires and the inner sleeve; and an attaching portion disposed at a terminal end of the plurality of wires, the inner sleeve, and the outer shell, the attaching portion being in electrical contact with at least the plurality of wires and the inner sleeve and being adapted to place at least the plurality of wires and the inner sleeve in electrical contact with a first electronic device These and other objects of the invention, as well as many of the intended advantages thereof, will become more readily apparent when reference is made to the following description, taken in conjunction with the accompanying drawings.

DETAILED DESCRIPTION OF THE EXEMPLARY EMBODIMENTS

Figure 1:
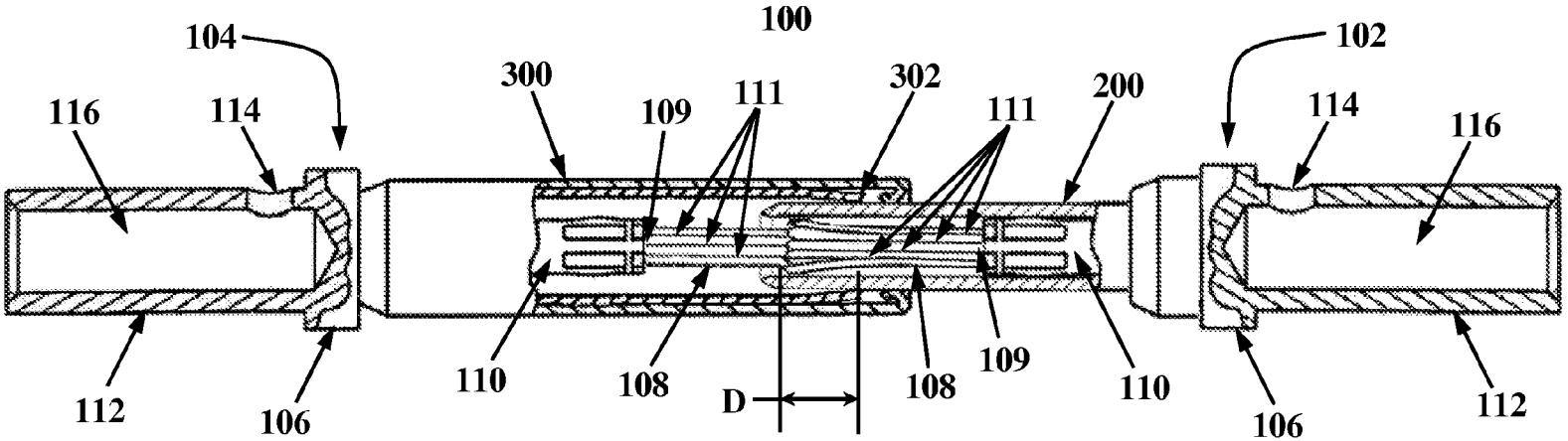
FIG. 1 illustrates an elevational view, in partial section, of the a non-limiting exemplary embodiment of a contact assembly pin/brush according to the present invention.

Reference will now be made in detail to non-limiting embodiments of the present invention by way of reference to the accompanying drawings, wherein like reference numerals refer to like parts, components and structures.

Turning to the figures, FIG. 1 illustrates an elevational view, in partial section, of a non-limiting exemplary embodiment of a contact assembly 100 that includes a pin/brush contact 102 and a socket/brush contact 104 according to the present invention. The pin/brush contact 102 and socket/brush contact 104 of the present invention are improved electrical contacts because, as described in more detail below, they provide a single contact that is small in size, that can carry a large amount of electric current, and that stays coupled during severe shock and vibration conditions.

As FIG. 1 illustrates, the pin/brush contact 102 and the socket/brush contact 104 each include a cylindrical collar portion 106 of a first diameter with a substantially cylindrical bundle of axially aligned wires 108 of a second smaller diameter extending from a forward end of the collar portion 106. The difference in diameters creates a step that provides a stop for each contact 102 and 104 when each is inserted through an orifice in, for example, an insulating housing (not shown). The terminal ends 109 of the bundles of axially aligned wires 108 are electrically attached to the contacts 102 and 104 at a first attaching portion 110, wherein each of the individual wires 108 is in electrical contact with at least one other wire 108 at a peripheral 111 surface thereof. The terminal ends 109 of the wires 108 can be fixed together within the first attaching portion 110 by substantially any attachment technique, such as soldering, brazing, welding, or crimping. In the illustrated embodiment, the terminal ends 109 of the wires 108 are crimped.

The pin/brush contact 102 and the socket/brush contact 104 also each include a second attaching portion 112 extending from a rear end of the collar portion 106 for electrically attaching each of the contacts to an electronic device via an electrical wire or a trace on a PCB. The second attaching portion 112 and the first attaching portion 110 are in electrical contact so that current can flow from the wires 108 to the electronic device to which the second attaching portion 112 is attached. The second attaching portion 112 may be provided in substantially any attachment style, such as crimp, solder, PC tail, or wire wrap. In the illustrated embodiment, the pin/brush contact 102 and the socket/brush contact 104 are each provided with a crimping second attaching portion 112. The crimping second attaching portion 112 includes an inspection hole 114 through which the end surfaces of an electrical wire can be inspected after being inserted into the bore 116 of the second attaching portion 112.

Figure 2:
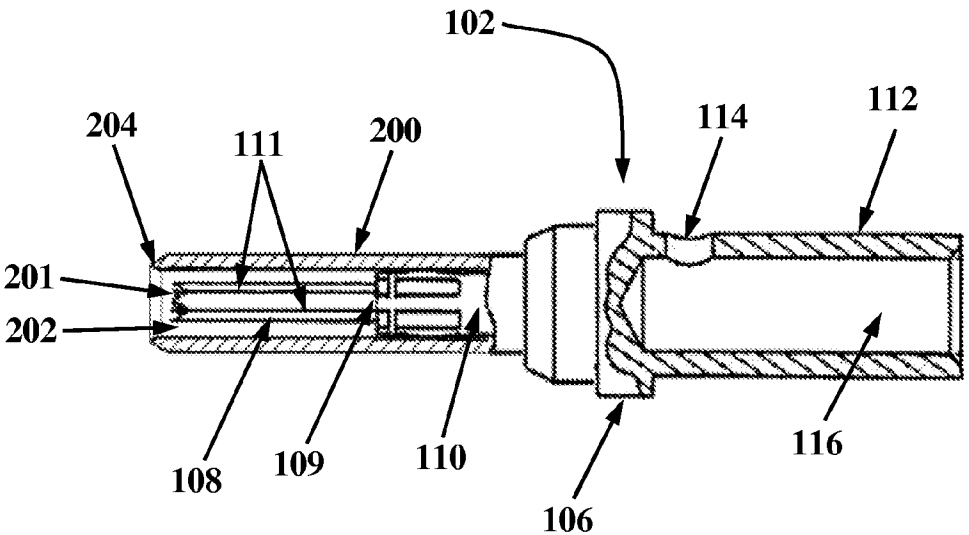
FIG. 2 illustrates an exploded elevational view, in partial section, of a non-limiting exemplary embodiment of the pin/brush contact illustrated in FIG. 1.

As FIG. 2 illustrates, the pin/brush contact 102 includes a pin-shaped cylindrical sleeve 200 surrounding the wires 108 and extending forward of the leading edges 201 of the wires 108 to prevent the wires 108 from being damaged or splayed when the contacts 102 and 104 are mated. The cylindrical sleeve 200 is formed of conductive material and is in electrical contact with at least the second attaching portion 112 of the pin/brush contact 102 so that current can flow from the cylindrical sleeve 200 to the electronic device to which the second attaching portion 112 is attached. Accordingly, the collar portion 106, the second attaching portion 112, and the cylindrical sleeve 200 may be integrally formed from the same piece of conductive material, such as a copper based alloy. They may also be formed from separate pieces of conductive material and mechanically attached by substantially any suitable means.

The cylindrical sleeve 200 includes a bore 202 of sufficient diameter to allow radial spreading of the wires 108 of each of the contacts 102 and 104 as they intermesh with each other (See, e.g., FIG. 1). The cylindrical sleeve 200 extends forward of the leading edges 201 of the wires 108 to prevent the wires from being damaged or splayed as the pin/brush contact 102 is inserted through an insulating housing or mated with the socket/brush contact 104. The cylindrical sleeve 200 is "pin shaped" in that it includes a leading edge 202 that is rounded, or chamfered, on an outside surface to guide the pin/brush contact 102 into the socket/brush contact 104. The leading edge 204 of the cylindrical sleeve 200 is also rounded, or chamfered, at an inside surface thereof, i.e., at the bore 202, to guide the wires 108 of the socket/brush contact 104 into the bore 202 of the cylindrical sleeve 200 as the pin/brush contact 102 is mated to the socket/brush contact 104. In addition, the cylindrical sleeve 200 of the pin/brush contact 102 is of sufficient thickness to carry electrical currents, including larger power-type currents that cannot be carried by conventional brush contacts.

Figure 3:
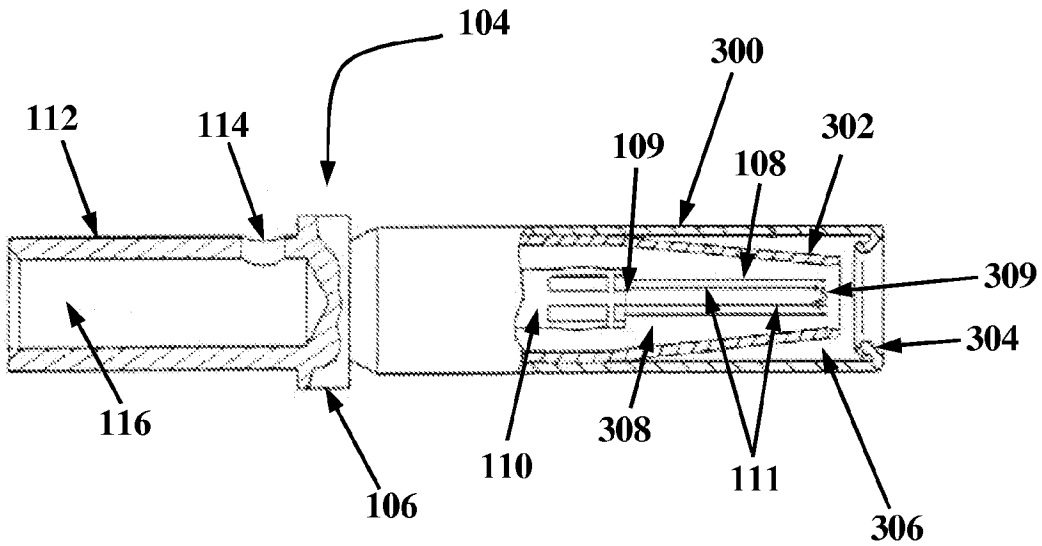
FIG. 3 illustrates an exploded elevational view, in partial section, of a non-limiting exemplary embodiment of the socket/brush contact illustrated in FIG. 1.

As FIG. 3 illustrates, the socket/brush contact 104 includes a cylindrical outer sleeve 300 and a conical inner sleeve 302. The outer sleeve 300 is hollow and includes a tapered entry portion 304 for guiding the leading edge 204 of the pin/brush contact 102 into the bore 306 of the outer sleeve 300 when the pin/brush contact 102 and socket/brush contact 104 are mated. The inner sleeve 302 is disposed within the bore 306 of the outer sleeve 300 and forms a conical bore 308 with the diameter at the leading end 402 (FIG. 4) being smaller than the outer diameter of the leading edge 204 of the pin/brush contact 102. The wires 108 of the socket/brush contact 104 are disposed in the conical bore 308 of the inner sleeve 302.

The inner sleeve 302 is formed of conductive material and is in electrical contact with at least the second attaching portion 112 of the socket/brush contact 104 so that current can flow from the inner sleeve 302 to the electronic device to which the second attaching portion 112 is attached. Accordingly, the collar portion 106, the second attaching portion 112, and the inner sleeve 302 may be integrally formed from the same piece of conductive material, such as a copper based alloy. They may also be formed from separate pieces of conductive material and mechanically attached by substantially any suitable means.

Like the inner sleeve 302, the outer sleeve 300 may also be formed integrally with the collar portion 106 and the second attaching portion 112 from a single piece of conductive material. And, the outer sleeve 300 may be formed separate from the collar portion 106 and the second attaching portion 112 using substantially any material, including a dielectric material. The outer sleeve 300 extends forward of the leading edges 309 of the wires 108 to prevent the wires from being damaged or splayed as the socket/brush contact 104 is inserted through an insulating housing. The outer sleeve 300 is preferably made out of a more resilient material than the inner sleeve 302, such as stainless steel, as its primary function is to protect the mated contacts from damage during mating and from the elements, such as moisture. When formed separately, the outer sleeve 300 may be mechanically attached to the collar portion 106 and the second attaching portion 112 by substantially any means.

Figure 4:
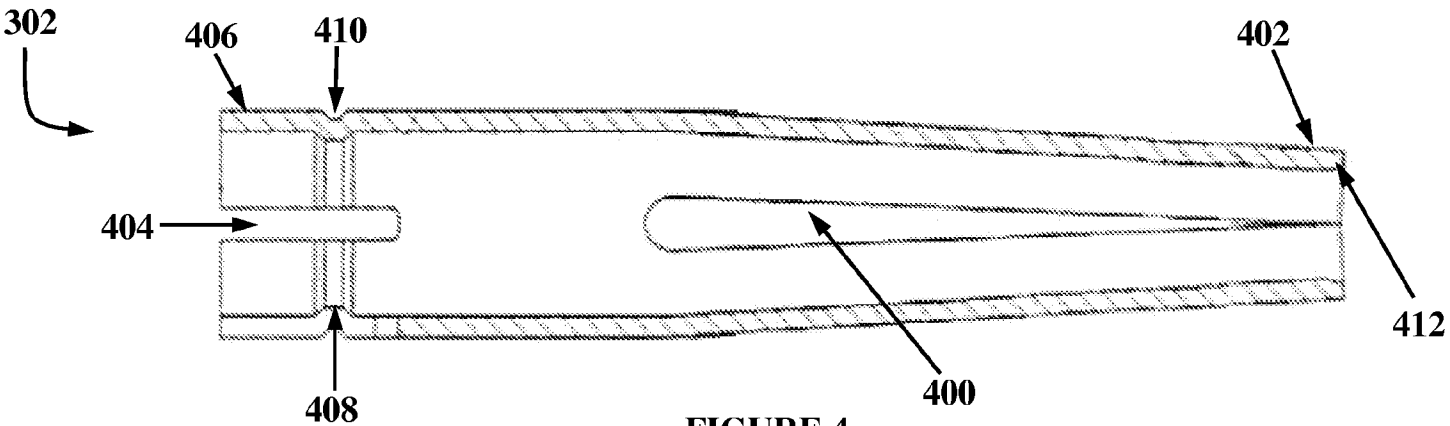
FIG. 4 illustrates a sectional view of a non-limiting exemplary embodiment of the inner sleeve illustrated in FIGS. 1 and 3.

As FIG. 4 illustrates, the inner sleeve 302 is formed separately from the collar portion 106 and the second attaching portion 112 and is adapted to be inserted within the outer sleeve 300. The inner sleeve 302 includes at least one forward slot 400 extending from the leading end 402 of the inner sleeve 302 axially along the length of the inner sleeve 302 so the leading end 402 of the inner sleeve 302 can be resiliently deflected in a radial direction when the pin/brush contact 102 is inserted therein. The inner sleeve 302 also includes at least one rear slot 404 extending from a terminal end 406 of the inner sleeve 302 axially along the length of the inner sleeve 302 so the terminal end 406 of the inner sleeve 302 can be resiliently deflected in a radial direction when installed around the first attaching portion 110 of the socket/brush contact 104.

The inner sleeve 302 includes an inwardly protruding annular rib 408 at the terminal end 406 that is adapted to engage a corresponding annular groove (not shown) on the first attaching portion 110 of the socket/brush contact 104 so as to resist axial forces applied to the inner sleeve 302 when the pin/brush contact 102 is installed therein and removed therefrom. An annular groove 410 is disposed around the outer circumferential surface of the inner sleeve 302 and may be adapted to similarly engage a corresponding inwardly protruding annular rib (not shown) disposed in the bore 306 of the outer sleeve 300 when the outer sleeve 300 is installed around the inner sleeve 302. The leading end 402 of the inner sleeve 302 includes a rounded, or chamfered, portion 412 at an inside surface thereof, i.e., at the bore 308, to guide the cylindrical sleeve 200 of the pin/brush contact 102 into the bore 308 of the inner sleeve 302 as the pin/brush contact 102 and the socket/brush contact 104 are mated together. In a preferred embodiment, the inner sleeve 302 includes two forward slots 400 disposed on opposite sides of the inner sleeve 302 and three rear slots 404 disposed equidistant from each other around the circumference of the inner sleeve 302.

As illustrated in FIG. 1, the contact assembly 100 is mated together by axially inserting the pin/brush contact 102 into the socket/brush contact 104 so that the two contacts are in telescopic engagement. When mated in this manner, the cylindrical sleeve 200 of the pin/brush contact 102 radially deflects the inner sleeve 302 of the socket/brush contact 104 and the wires 108 of each of the pin/brush contact 102 and the socket/brush contact 104 elastically deform and intermesh over a distance "D". As the wires 108 of each of the contacts 102 and 104 intermesh and spread radially, they exert radial forces on each other. The radial forces between the cylindrical sleeve 200 of the pin/brush contact 102 and the inner sleeve 302 of the socket/brush contact 104 and the radial forces between the wires 108 create both mechanical and electrical connections between the pin/brush contact 102 and the socket/brush contact 104. In a preferred embodiment, the pin/brush contact 102 and the socket/brush contact 104 are configured so that the intermesh distance "D" is approximately 0.075 inches.

When intermeshed, the wires 108 of the pin/brush contact 102 and socket/brush contact 104 provide redundant current paths because there are typically between 14 and 70 points of contact per mated pin/brush contact 102 and socket/brush contact 104. Those redundant current paths allow the pin/brush contact 102 and socket/brush contact 104 to remain coupled during severe shock and vibration conditions, greatly reducing current discontinuities. Accordingly, the pin/brush contact 102 and socket/brush contact 104 provide a well-defined and controlled impedance path during such conditions.

In addition, by providing for the flow of electrical current between the pin/brush contact 102 and socket/brush contact 104 via the electrical contact between the cylindrical sleeve 200 of the pin/brush contact 102 and the inner sleeve 302 of the socket/brush contact 104 and the electrical contact between the wires 108 of the pin/brush contact 102 and socket/brush contact 104, a larger area of electrical contact area is provided in a smaller amount of total space, i.e., the contact ratio is improved for the contacts. The increased contact ratio results in a lower electrical resistance, a lower voltage drop, and a lower temperature across the contacts. Thus, the present invention provides contacts that are suitable for carrying large amounts of electrical current and are resistant to severe shock and vibration conditions, which allows more freedom of design when manufacturing high-density electrical connectors.

In an alternative embodiment of the present invention, an insulating layer (not shown) may be disposed between the wires 108 and the cylindrical sleeve 200 of the pin/brush contact 102 and between the wires 108 and the inner sleeve 302 of the socket/brush contact 104 to form a coaxial connector. In that alternative embodiment, an insulating layer (not shown) may also be disposed between an inner portion and outer portion of the collar portion 106 and second attaching portion 112 to maintain electrical separation between the current flowing through the wires 108 of the pin/brush contact 102 and socket/brush contact 104 and the current flowing through the cylindrical sleeve 200 of the pin/brush contact 102 and the inner sleeve 302 of the socket/brush contact 104. Accordingly, the features of the present invention may also be utilized in a novel coaxial connector.

The foregoing description and drawings should be considered as illustrative only of the principles of the invention. The invention may be configured in a variety of shapes and sizes and is not intended to be limited by the preferred embodiment. Numerous applications of the invention will readily occur to those skilled in the art. Therefore, it is not desired to limit the invention to the specific examples disclosed or the exact construction and operation shown and described. Rather, all suitable modifications and equivalents may be resorted to, falling within the scope of the invention.

What is claimed is:

1. An electrical contact, comprising:

a plurality of axially-aligned electrically conductive wires with a leading end and a terminal end, each wire being in electrical contact with at least one other wire at a peripheral surface thereof;

an electrically conductive inner sleeve with a leading end disposed around the leading end of the plurality of wires and a terminal end attached to the terminal end of the plurality of wires;

an outer sleeve disposed around the inner sleeve for protecting the leading end of the plurality of wires and the inner sleeve; and an attaching portion disposed at the terminal end of the plurality of wires and the inner sleeve, the attaching portion being in electrical contact with at least the plurality of wires and the inner sleeve and being adapted to place at least the plurality of wires and the inner sleeve in electrical contact with a first electronic device.

2. The electrical contact of claim 1, wherein the plurality of wires has a diameter smaller than a collar portion disposed between the attaching portion and the plurality of wires, thereby defining a step portion that provides a stop.

3. The electrical contact of claim 1, wherein the attaching portion includes a connecting portion at a leading end adapted to connect the attaching portion to the plurality of wires by at least one of soldering, brazing, welding, and crimping.

4. The electrical contact of claim 1, wherein the attaching portion is adapted to attach to a 16 gauge electrical wire or smaller.

5. The improved electrical contact of claim 1, wherein the inner sleeve includes an inwardly protruding annular rib at a rear end thereof that is adapted to engage a corresponding annular groove on the attaching portion.

6. The electrical contact of claim 1, wherein the attaching portion and the inner sleeve are integrally formed from a single piece of conductive material.

7. The electrical contact of claim 1, wherein the attaching portion and the outer sleeve are integrally formed from a single piece of conductive material.

8. The electrical contact of claim 1, wherein the outer sleeve is formed from at least one of a dielectric material and stainless steel.

9. A first electrical contact comprising:

a plurality of axially-aligned electrically conductive wires, each wire being in electrical contact with at least one other wire at a peripheral surface thereof;

an electrically conductive inner sleeve disposed around the plurality of wires;

an outer sleeve disposed around the inner sleeve for protecting at least a leading end of the plurality of wires and the inner sleeve; and an attaching portion disposed at a terminal end of the plurality of wires, the attaching portion being in electrical contact with at least the plurality of wires and the inner sleeve and being adapted to place at least the plurality of wires and the inner sleeve in electrical contact with a first electronic device, wherein the inner sleeve is adapted to receive a second electrical contact therein that includes:

a plurality of axially-aligned electrically conductive wires, each wire being in electrical contact with at least one other wire at a peripheral surface thereof; and an electrically conductive sleeve disposed around the plurality of wires for carrying electrical current and protecting at least a leading end of the plurality of wires, wherein the plurality of wires of the first electrical contact will be in electrical contact with the plurality of wires of the second electrical contact and the inner sleeve of the first electrical contact will be in electrical contact with the sleeve of the second contact when the electrical contact and the second electrical contact are mated together.

10. The electrical contact of claim 9, wherein the inner sleeve includes a tapered entry portion for guiding a leading end of the sleeve of the second contact into the outer sleeve.

11. An electrical contact assembly, comprising:

a first electrical contact that includes a first plurality of axially-aligned electrically conductive wires, each wire being in electrical contact with at least one other wire at a peripheral surface thereof, a first electrically conductive sleeve disposed around the first plurality of wires and having at least one slot extending axially from a leading end that is adapted to allow the first sleeve to expand radially, an outer sleeve disposed around the first sleeve for protecting at least a leading end of the first plurality of wires and the first sleeve, and a first attaching portion disposed at a terminal end of the first plurality of wires, the first attaching portion being in electrical contact with at least the first plurality of wires and the first sleeve and being adapted to place at least the first plurality of wires and the first sleeve in electrical contact with a first electronic device; and a second electrical contact that includes a second plurality of axially-aligned electrically conductive wires, each wire being in electrical contact with at least one other wire at a peripheral surface thereof, an second electrically conductive sleeve disposed around the plurality of wires for carrying electrical current and protecting at least a leading end of the second plurality of wires, and a second attaching portion disposed at a terminal end of the second plurality of wires and the second sleeve, the second attaching portion being in electrical contact with at least the second plurality of wires and the second sleeve and being adapted to place at least the second plurality of wires and the second sleeve in electrical contact with a second electronic device, wherein the first sleeve is adapted to receive the second sleeve therein and create a first location of electrical contact between the first and second electrical contacts, and wherein the first plurality of wires and second plurality of wires are adapted to intermesh with each other to create a second location of electrical contact between the first and second electrical contacts.

12. The electrical contact assembly of claim 11, wherein the first sleeve includes a tapered entry portion for guiding a leading end of the second sleeve into the first sleeve as the first electrical contact is mated with the second electrical contact.

13. The electrical contact assembly of claim 11, wherein the first plurality of wires has a diameter smaller than a first collar portion disposed between the first attaching portion and the first plurality of wires, thereby defining a first step portion that provides a first stop; and the second plurality of wires has a diameter smaller than a second collar portion disposed between the second attaching portion and the second plurality of wires, thereby defining a second step portion that provides a second stop.

14. The electrical contact assembly of claim 11, wherein the first attaching portion includes a first connecting portion at a leading end adapted to connect the first attaching portion to the first plurality of wires by at least one of soldering, brazing, welding, and crimping; and the second attaching portion includes a second connecting portion at a leading end adapted to connect the second attaching portion to the second plurality of wires by at least one of soldering, brazing, welding, and crimping.

15. The electrical contact assembly of claim 11, wherein the at least one of the first attaching portion and second attaching portion is adapted to attach to a 16 gauge electrical wire or smaller.

16. The electrical contact assembly of claim 11, wherein the first sleeve includes an inwardly protruding annular rib at a rear end thereof that is adapted to engage a corresponding annular groove on the first attaching portion.

17. The electrical contact assembly of claim 11, wherein the first attaching portion and the first sleeve are integrally formed from a single first piece of conductive material; and the second attaching portion and the second sleeve are integrally formed from a single second piece of conductive material.

18. The electrical contact assembly of claim 11, wherein the second attaching portion and the second sleeve are integrally formed from a single second piece of conductive material.

19. The electrical contact assembly of claim 11, wherein the outer sleeve is formed from at least one of a dielectric material and stainless steel.

20. The electrical contact assembly of claim 11, wherein the first plurality of wires and second plurality of wires are adapted to intermesh over a distance of approximately 0.75 inches.

* * * * *